US006903702B2

(12) United States Patent
Kawai et al.

(10) Patent No.: US 6,903,702 B2
(45) Date of Patent: Jun. 7, 2005

(54) RADIO EQUIPMENT

(75) Inventors: Shigekazu Kawai, Gunma-ken (JP); Tsutomu Ishikura, Gunma-ken (JP); Yutaka Saito, Saitama-ken (JP); Tsutomu Tanaka, Kanagawa-ken (JP); Kazuo Matsubara, Saitama-ken (JP)

(73) Assignee: Sanyo Electric Co., Ltd., Osaha-fu (JP)

( * ) Notice: Subject to any disclaimer, the term of this patent is extended or adjusted under 35 U.S.C. 154(b) by 127 days.

(21) Appl. No.: 10/352,174

(22) Filed: Jan. 28, 2003

(65) Prior Publication Data

US 2003/0169211 A1 Sep. 11, 2003

(30) Foreign Application Priority Data

Feb. 8, 2002 (JP) ..... 2002-033104

(51) Int. Cl.[7] ..... H01Q 9/16
(52) U.S. Cl. ..... 343/793; 343/829; 343/850
(58) Field of Search ..... 343/700 MS, 829, 343/830, 793, 850, 895

(56) References Cited

U.S. PATENT DOCUMENTS 5,181,025 A * 1/1993 Ferguson et al. ..... 340/870.21
2004/0032377 A1 * 2/2004 Forster et al. ..... 343/895

* cited by examiner

*Primary Examiner*—Shih-Chao Chen
(74) *Attorney, Agent, or Firm*—Sughrue Mion, PLLC

(57) ABSTRACT

An antenna is provided as a substrate member, and, as with the antenna, a ground part is provided as a substrate member. The ground part includes a folded pattern formed of a copper foil provided on the surface of a substrate material. When a folded pattern in the antenna and the folded pattern in the ground part are configured in a length of λ/4, a pseudo-antenna having a length of λ/2 can be formed. In this case, the antenna gain is about 2 dB, that is, the radiation of the radio wave can be improved. At the same time, the antinoise properties and the arrival distance of the radio wave can be improved. That is, the above construction can realize radio equipment which can stably radiate radio waves even under ungroundable conditions and, at the same time, can realize good characteristics even under low transmission output conditions.

15 Claims, 9 Drawing Sheets

RADIO EQUIPMENT

BACKGROUND OF THE INVENTION

1. Field of the Invention

The invention relates to radio equipment and more particularly to radio equipment which can ensure good transmission of radio waves even when the provision of a ground structure (ground) is difficult.

2. Prior Art

In order to efficiently radiate radio waves from an antenna connected to radio equipment, a circuit of the radio equipment or the body of the device has hitherto been grounded to the earth to provide electrical connection to the earth.

FIG. 1 is a schematic diagram showing the construction of a conventional radio transmitter. This radio transmitter 20 includes a signal wave generator 21 for generating a signal wave such as voice, an oscillator 22 for generating a high-frequency carrier, a modulator 23 for modulating the carrier by the signal wave according to a predetermined modulating method, an amplifier 24 for amplifying the modulated wave output from the modulator 23 to provide necessary electric power which is then supplied to an antenna 25, a power supply wire 26 for supplying electric power to each part, a power supply 27 for supplying electric power through the power supply wire 26, and a ground wire 29 for grounding a common ground 26A to the earth 28.

Regarding stable radiation of a modulated wave from the antenna 25, a common recognition in the art is that minimizing the grounding resistance derived from the ground wire 29 is preferred. When the grounding resistance can be minimized, reference potential high enough to operate the antenna 25 can be ensured and the drive of the antenna 25 can be accelerated to improve the radiation of the radio wave.

In the conventional radio equipment, however, when satisfactory grounding cannot be ensured, the reference potential becomes unstable and, consequently, the radiation of the radio wave is lowered. The lowered radiation results in lowered radio transmission efficiency, or otherwise the radio transmission becomes impossible. This tendency is significant particularly under such a condition that the transmission output is low.

SUMMARY OF THE INVENTION

Accordingly, it is an object of the invention to provide radio equipment which can stably radiate radio waves even under ungroundable conditions and, at the same time, can realize good characteristics even under low transmission output conditions.

According to the first feature of the invention, radio equipment comprises:

an antenna for radiating radio waves; and a ground part configured as an antenna armature so as to be equivalent to the antenna.

According to the second feature of the invention, radio equipment comprises:

an antenna for radiating radio waves; and a ground part configured in the same form as the antenna.

According to the third feature of the invention, radio equipment comprises:

an antenna for radiating radio waves;

a sensor for measuring a physical quantity and converting the physical quantity to an electric signal which is then output;

a transmission circuit for sending the electric signal as the radio wave;

a casing for housing therein the transmission circuit and the sensor; and a ground part configured as an antenna armature so as to be equivalent to the antenna.

According to the fourth feature of the invention, radio equipment comprises:

an antenna for radiating radio waves;

a sensor for measuring a physical quantity and converting the physical quantity to an electric signal which is then output;

a transmission circuit for sending the electric signal as the radio wave;

a casing for housing therein the transmission circuit, said sensor being provided separately from and outside the casing, said sensor and said transmission circuit being connected to a common ground; and a ground part configured as an antenna armature so as to be equivalent to the antenna.

According to the fifth feature of the invention, radio equipment comprises:

an antenna for radiating radio waves;

a ground part configured as an antenna armature so as to be equivalent to the antenna; and a balanced matching part provided between the transmission circuit and the ground part for electrically realizing matching therebetween.

According to the radio equipment in each of the first to fifth features of the invention, preferably, the antenna and the ground part each are formed of a conductor having at least one quarter of the wavelength of the radio wave. Further, preferably, the ground part is formed of a copper foil pattern provided on a circuit board.

According to the radio equipment in each of the first to fifth features of the invention, the formation of a pseudo-equipotential surface as a ground using a part of the circuit construction of radio equipment can realize the radiation of radio waves with high efficiency even when grounding to the earth is impossible.

BRIEF DESCRIPTION OF THE DRAWINGS

The invention will be explained in more detail in conjunction with the appended drawings, wherein.

DESCRIPTION OF THE PREFERRED EMBODIMENTS

Preferred embodiments of the radio equipment according to the invention will be explained in detail in conjunction with the accompanying drawings.

Figure 1:
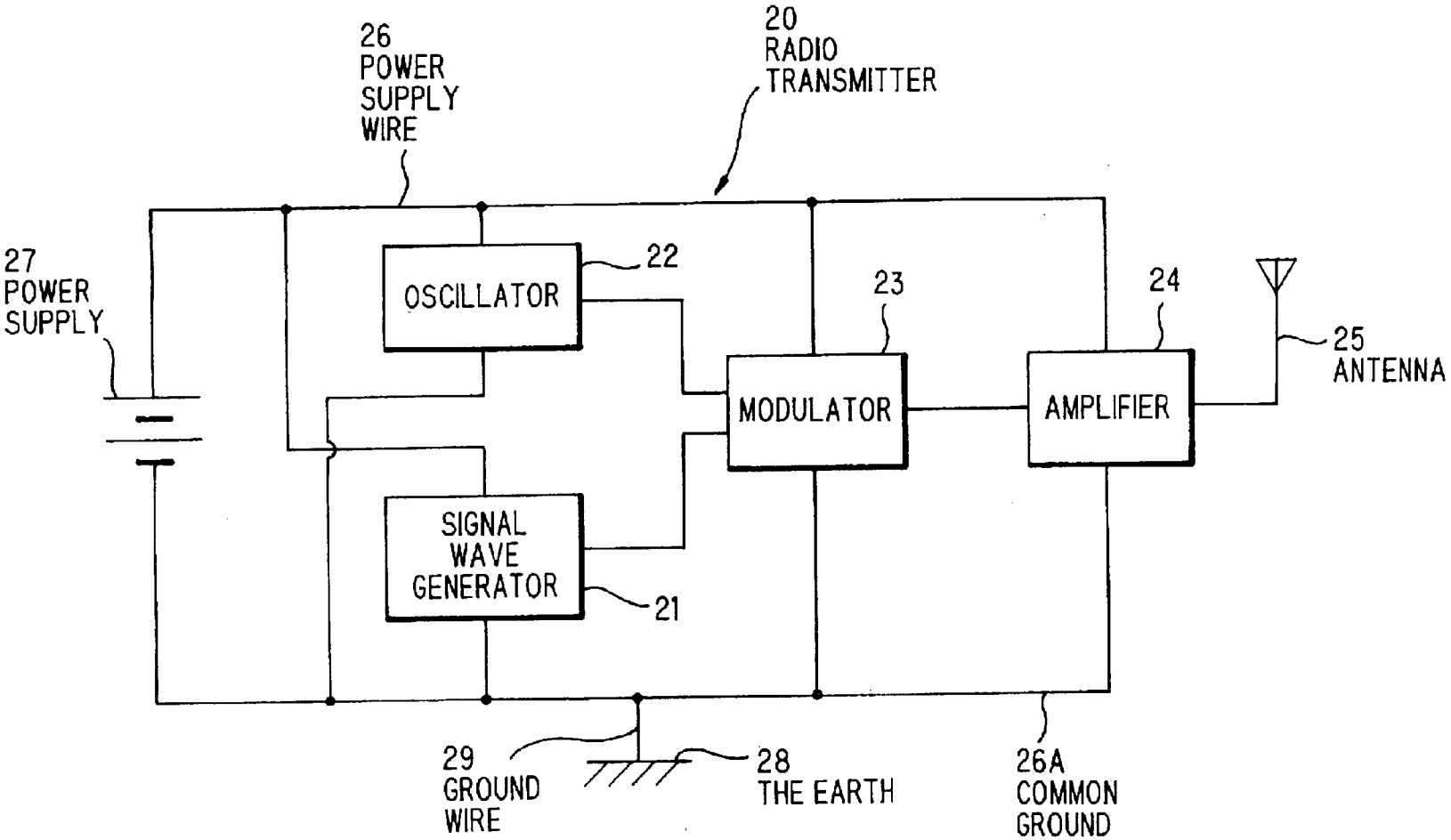
FIG. 1 PRIOR ART
FIG. 1 is a schematic diagram showing the construction of a conventional radio transmitter.
Figure 2:
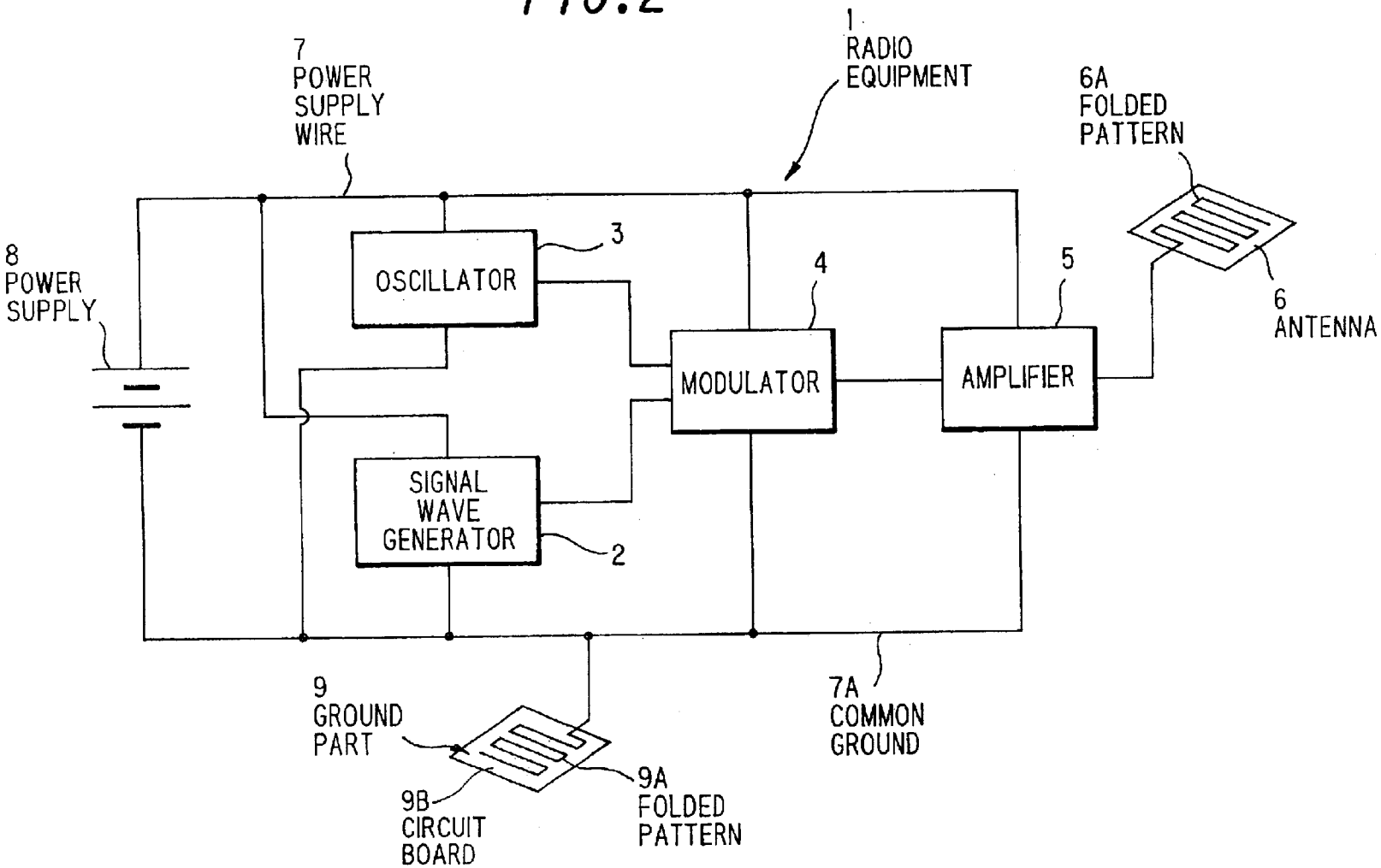
FIG. 2 is a schematic diagram showing the construction of radio equipment in a first preferred embodiment of the invention.

FIG. 2 is a schematic diagram showing radio equipment in a first preferred embodiment of the invention. This radio equipment 1 includes a signal wave generator 2 for generating a signal wave such as voice, an oscillator 3 for generating a high-frequency carrier, a modulator 4 for modulating the carrier by the signal wave according to a predetermined modulating method, an amplifier 5 for amplifying the modulated wave output from the modulator 4 to provide necessary electric power, an antenna 6 for radiating the amplified modulated wave as a radio wave, a power supply wire 7 for supplying electric power to each part, a power supply 8 which is a battery for supplying electric power through the power supply wire 7, and a ground part 9 which is electrically connected to a common ground 7A and is configured in the same manner as in the antenna 6.

The antenna 6 is provided as a substrate member that can be housed in a casing (not shown) in which the radio equipment 1 can be housed. The antenna 6 includes a folded pattern 6A formed of a copper foil provided on the surface of a substrate material. The antenna 6 is configured so that the length of the folded pattern 6A is one quarter of the wavelength λ of the modulated wave.

As with the antenna 6, the ground part 9 is provided as a substrate member and includes a folded pattern 9A formed of a copper foil provided on the surface of a circuit board 9B. The ground part 9 is configured so that the length of the folded pattern 9A is one quarter of the wavelength λ of the modulated wave.

Figure 3:
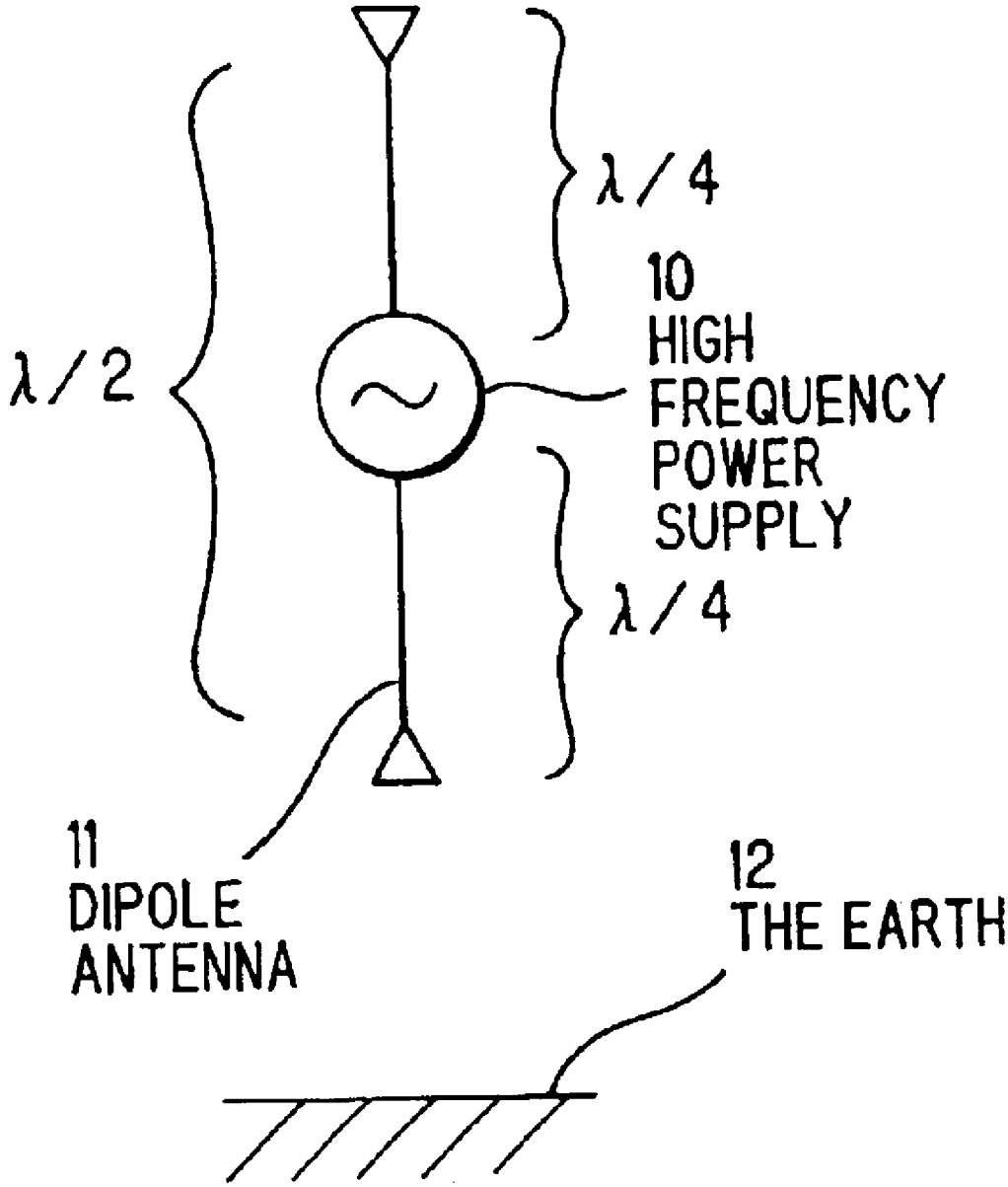
FIG. 3 is a diagram showing the construction of a circuit of an antenna provided in radio equipment.

FIG. 3 shows the construction of a circuit in an antenna provided in the radio equipment 1. As shown in the drawing, a dipole antenna 11 of two perfect balanced lines connected to a high-frequency power supply 10 is provided by configuring the antenna and the ground so as to be electrically equivalent to each other based on the folded patterns 6A and 9A. This dipole antenna 11 is provided in noncontact with the earth 12. In this way, a pseudo-antenna having a length of one half of the wavelength λ can be formed by configuring the folded patterns 6A and 9A each in a length of one quarter of the wavelength λ. In this case, the antenna gain is about 2 dB, that is, the radiation of the radio wave can be improved. At the same time, the antinoise properties and the arrival distance of the radio wave can be improved.

Figure 4:
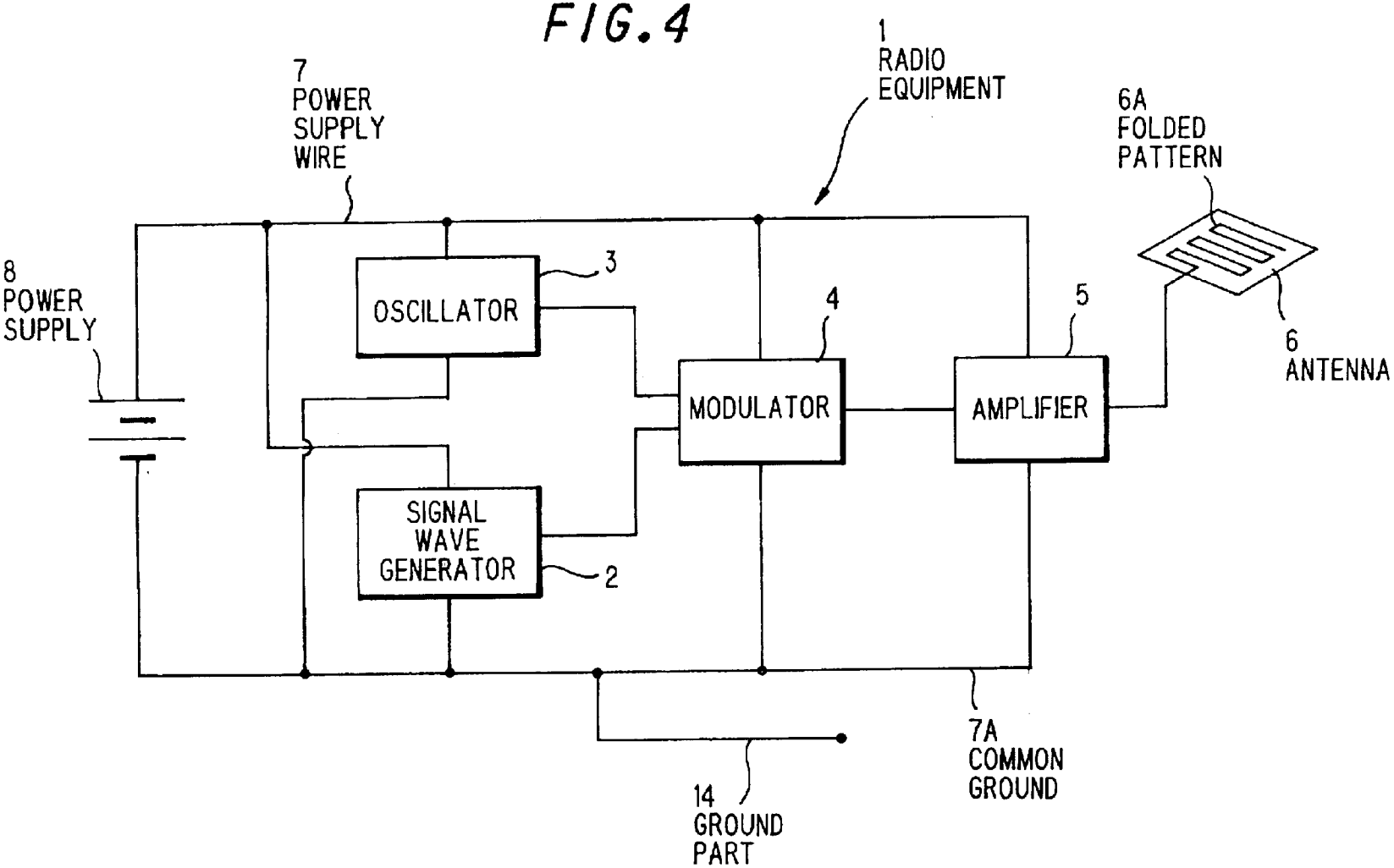
FIG. 4 is a schematic diagram showing the construction of radio equipment in a second preferred embodiment of the invention.

FIG. 4 is a schematic diagram showing radio equipment in a second preferred embodiment of the invention. This radio equipment 1 includes a signal wave generator 2 for generating a signal wave such as voice, an oscillator 3 for generating a high-frequency carrier, a modulator 4 for modulating the carrier by the signal wave according to a predetermined modulating method, an amplifier 5 for amplifying the modulated wave output from the modulator 4 to provide necessary electric power, an antenna 6 for radiating the amplified modulated wave as a radio wave, a power supply wire 7 for supplying electric power to each part, a power supply 8 which is a battery for supplying electric power through the power supply wire 7, and a ground part 14 which is electrically connected to a common ground 7A to form a pseudo-equipotential surface.

The ground part 14 is provided as an antenna armature in a length (λ/4) necessary for forming a potential equivalent to that of the folded pattern 6A in the antenna 6. The ground part 14 may be in the form of a conductor wire, or alternatively may be in the form of a rod member made of a highly electrically conductive metal or a resin member made of an electrically conductive plastic or the like.

The provision of the ground part 14 also can configure a pseudo-dipole antenna 11 of two perfect balanced lines shown in FIG. 3 and thus can contribute to improved radiation of radio waves. Therefore, the arrival distance of the radio wave can be improved even in the case of low electric power, and, at the same time, antinoise properties can be improved.

Figure 5:
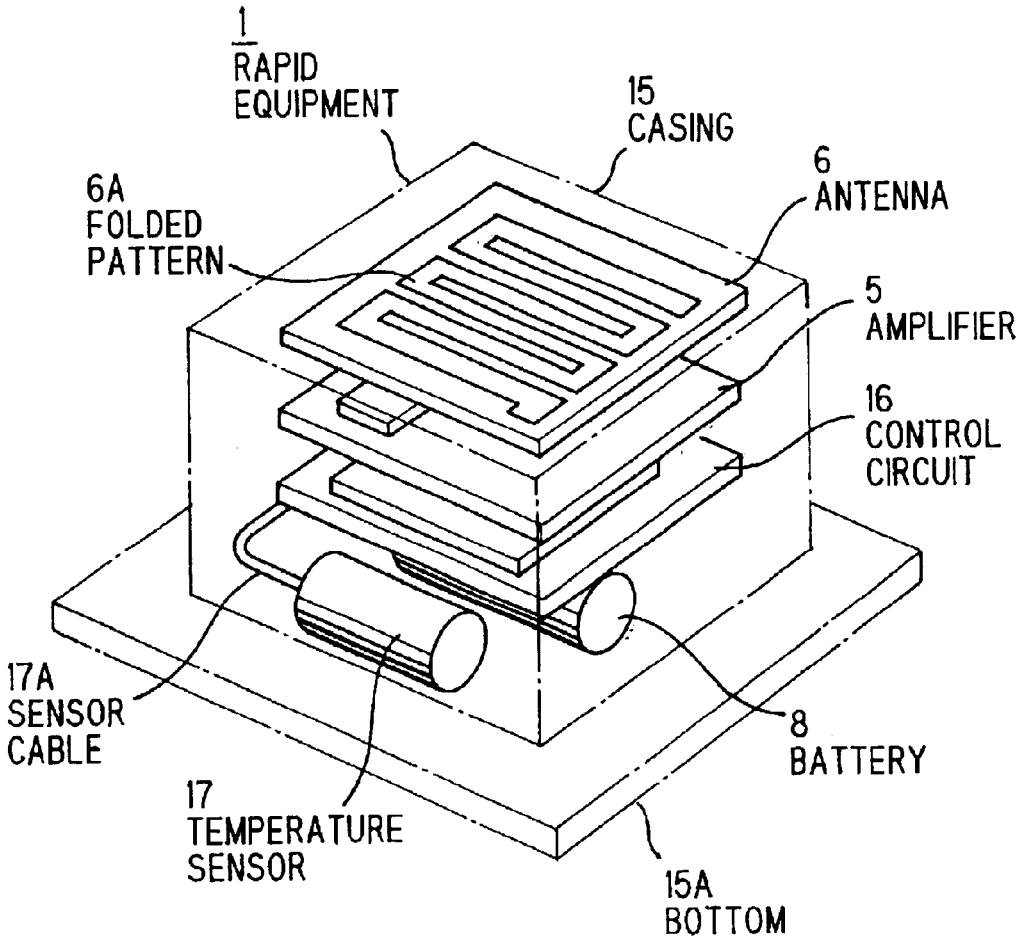
FIG. 5 is a perspective view showing a temperature monitoring apparatus in a third preferred embodiment of the invention.

FIG. 5 shows a temperature monitoring apparatus, as radio equipment in a third preferred embodiment of the invention, in which a ground (GND) wire of a temperature sensor provided as a sensor for measuring physical quantity is used as a ground part. In this temperature monitoring apparatus 1, an amplifier 5 provided as a substrate member, an antenna 6, a control circuit 16 including an oscillator, a signal wave generator, and a modulator, and a temperature sensor 17 for measuring the temperature of an object to be monitored are housed in a stacked form in a casing 15 formed of polycarbonate. The temperature sensor 17 is housed in the casing 15 so that a part of the temperature sensor 17 is exposed on a bottom 15A of the casing 15. The exposed part is brought into contact with the object to be monitored to measure the temperature through the utilization of thermal conduction. The antenna 6 has a folded pattern 6A of a copper foil provided on the surface of the substrate member. The temperature sensor 17 is connected to the control circuit 16 through a sensor cable 17A. The sensor cable 17A includes a power supply wire, a sensor signal wire, and a GND wire which have been integrated by covering with a sheath. A battery 8 is housed in a space provided in the lower part of the control circuit 16. The antenna 6 and the GND wire each have a length of one quarter of the wavelength λ, i.e., λ/4.

Figure 6:
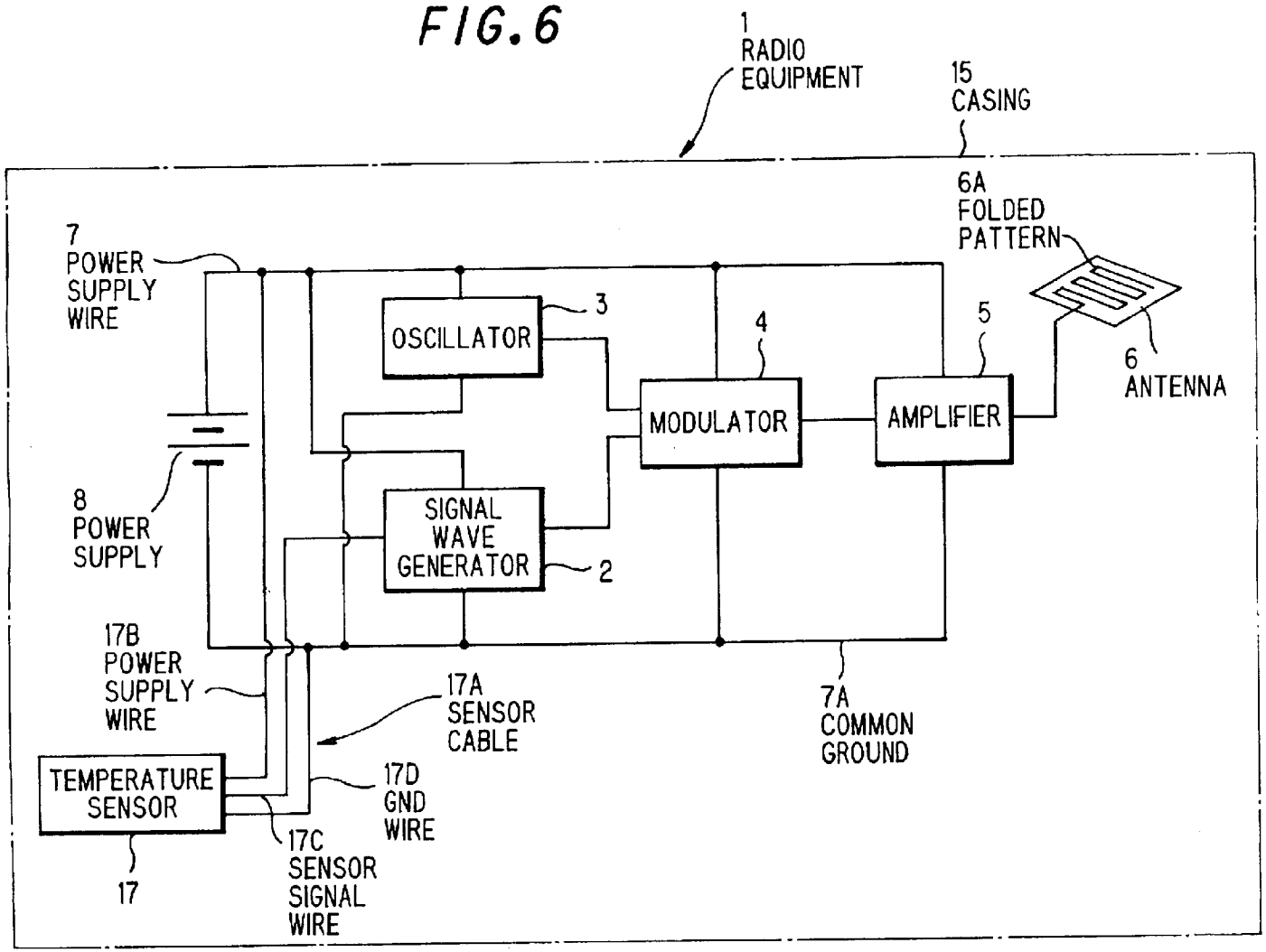
FIG. 6 is a block diagram of a circuit in the temperature monitoring apparatus in the third preferred embodiment of the invention.

FIG. 6 is a block diagram showing a circuit in the temperature monitoring apparatus shown in FIG. 5. In FIG. 5 showing the first preferred embodiment and FIG. 6, like parts are identified with the same reference numerals, and the overlapped explanation thereof will be omitted. The sensor cable 17A in the temperature sensor 17 includes a power supply wire 17B, a sensor signal wire 17C, and a GND wire 17D with a length of λ/4. The GND wire 17D is electrically connected to the common ground 7A.

In this temperature monitoring apparatus, the temperature sensor 17 is attached to an object to be monitored, and a temperature signal measured in a predetermined measurement cycle is converted to a signal wave in a signal wave generator. The signal wave is subjected to ASK (amplitude shift keying) modulation in a modulator, and the modulated wave is amplified to an electric power necessary for transmission. The amplified wave is then sent as a radio wave of 315 MHz from the antenna 6. The transmitted radio wave is received by a receiver (not shown). Thus, the temperature of the object to be monitored can be remotely grasped.

In this temperature monitoring apparatus, the GND wire 17D in the sensor cable 17A connected to the temperature sensor 17 housed within the casing 15 is used as a ground part for configuring a pseudo-equipotential surface, and the length of the GND wire 17D is brought to λ/4. By virtue of this construction, a pseudo-dipole antenna of two perfect balanced lines can be provided. Therefore, the radiation of radio waves can be improved.

In the third preferred embodiment, the construction, in which the temperature sensor 17 for measuring the temperature of an object to be monitored is provided as a physical quantity measuring sensor, has been explained. The physical quantity to be measured, however, is not limited to the temperature, and any physical quantity, which can be converted to an electric signal, can be transmitted as a radio wave. Specifically, other measurable physical quantities include, for example, humidity, strain (stress), quantity of light, flow rate, and vibration (acceleration).

Further, it should be noted that the length of the GND wire 17D is not limited to λ/4. For example, the use of two λ/4-long ground wires, i.e., a length of 2×λ/4, may be adopted. In this case, a plurality of maximum amplitude points in an antenna can be ensured. Therefore, radio waves can be more stably radiated.

Figure 7:
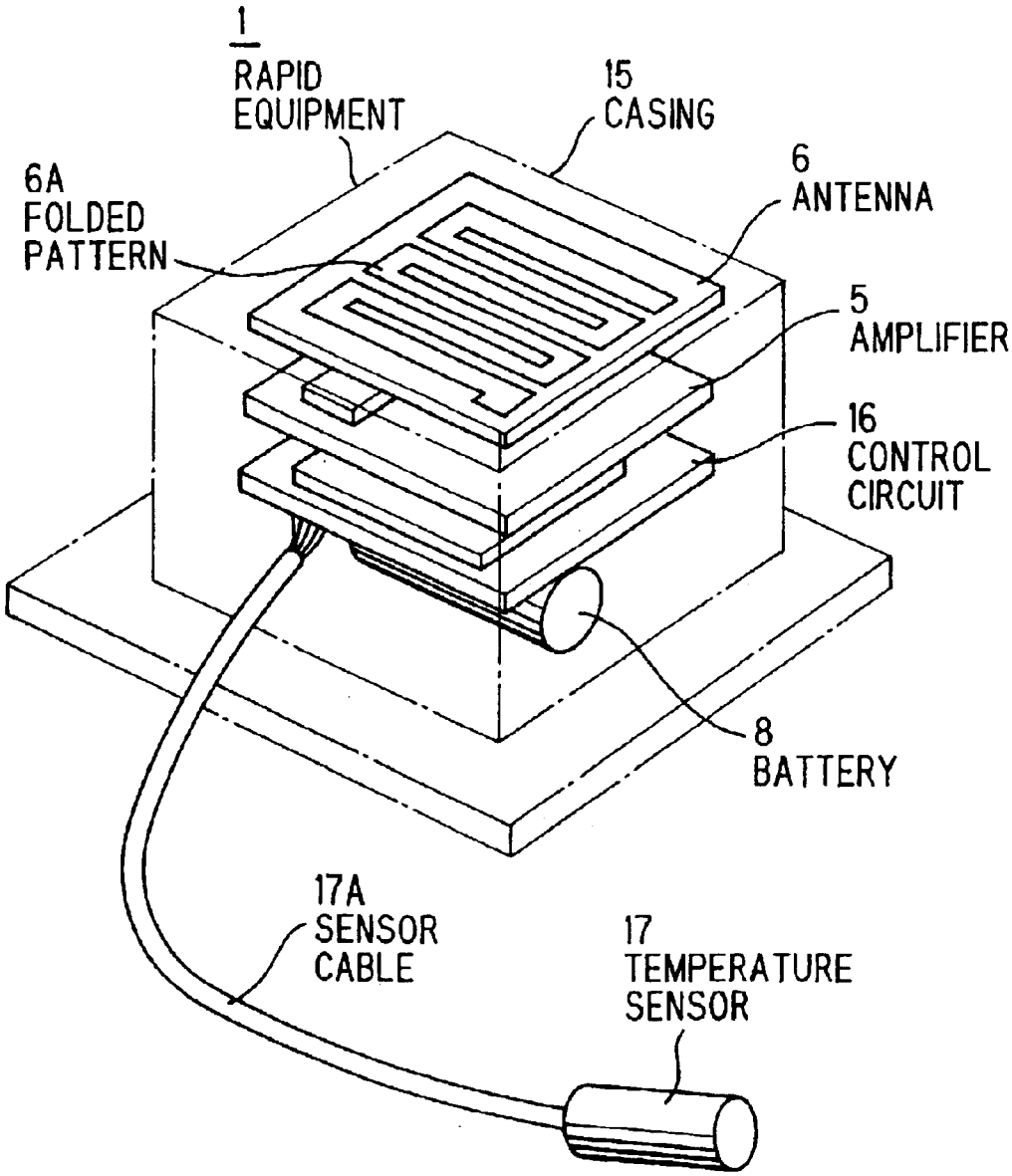
FIG. 7 is a perspective view showing a temperature monitoring apparatus in a fourth preferred embodiment of the invention.

FIG. 7 shows another temperature monitoring apparatus, as radio equipment in a fourth preferred embodiment of the invention, in which a GND wire of a temperature sensor provided as a sensor for measuring physical quantity is used as a ground part. In this temperature monitoring apparatus 1, an amplifier 5 provided as a substrate member, an antenna 6, and a control circuit 16 including an oscillator, a signal wave generator, and a modulator are housed in a stacked form in a casing 15 formed of polycarbonate. A temperature sensor 17 is externally provided separately from the casing 15. The antenna 6 has a folded pattern 6A of a copper foil provided on the surface of the substrate member. The temperature sensor 17 is connected to the control circuit 16 through a sensor cable 17A. The sensor cable 17A includes a power supply wire, a sensor signal wire, and a GND wire which have been integrated by covering with a sheath. A battery 8 is housed in a space provided in the lower part of the control circuit 16. The antenna 6 and the GND wire each have a length of λ/4.

Figure 8:
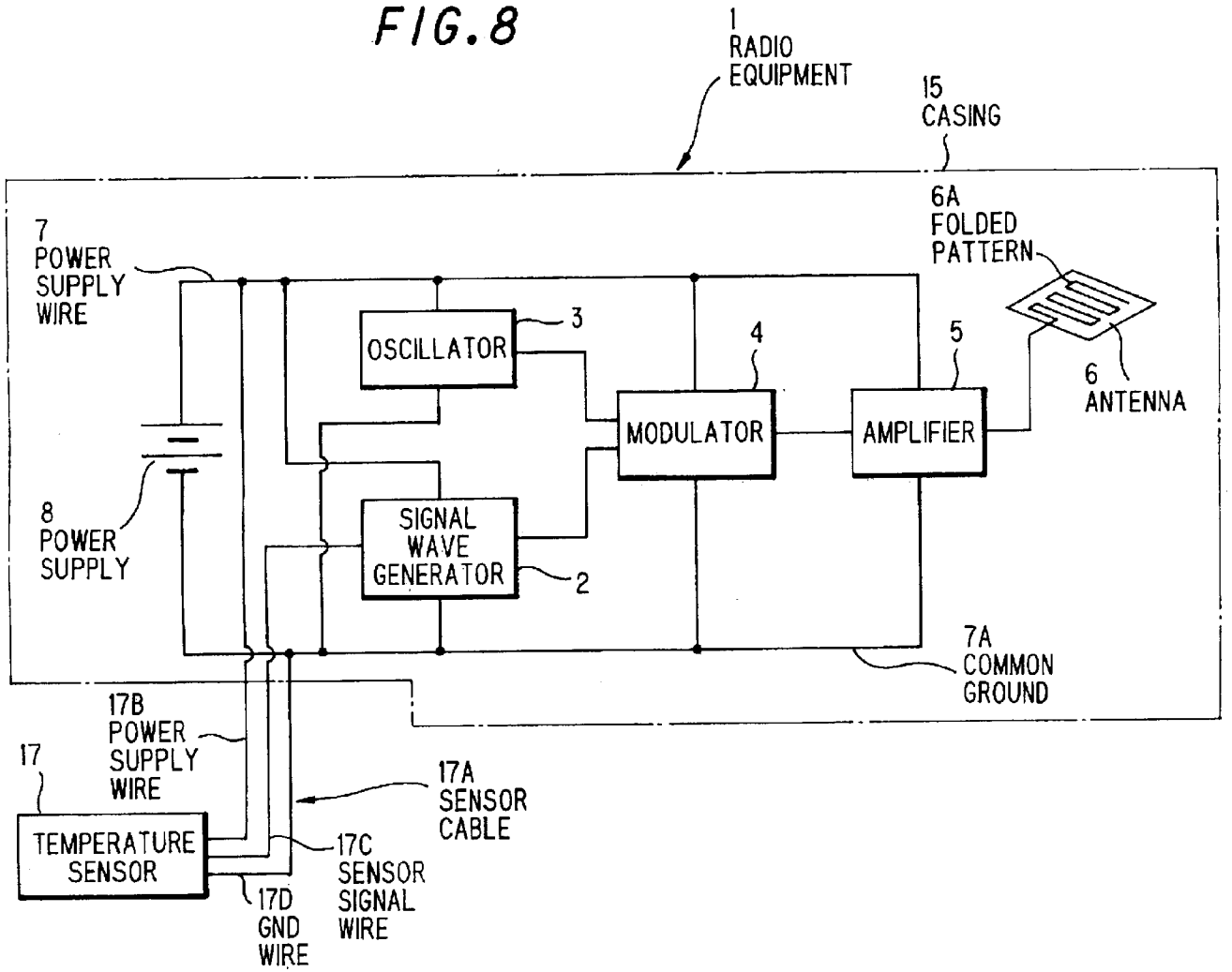
FIG. 8 is a block diagram of a circuit in the temperature monitoring apparatus in the fourth preferred embodiment of the invention.

FIG. 8 is a block diagram showing a circuit in the temperature monitoring apparatus shown in FIG. 7. In FIG. 5 showing the first preferred embodiment and FIG. 8, like parts are identified with the same reference numerals, and the overlapped explanation thereof will be omitted. The sensor cable 17A in the temperature sensor 17 includes a power supply wire 17B, a sensor signal wire 17C, and a GND wire 17D with a length of λ/4. The GND wire 17D is electrically connected to the common ground 7A provided within the casing 15.

In this temperature monitoring apparatus, the temperature sensor 17 is attached to an object to be monitored, and a temperature signal measured in a predetermined measurement cycle is converted to a signal wave in a signal wave generator. The signal wave is subjected to ASK modulation in a modulator, and the modulated wave is amplified to an electric power necessary for transmission. The amplified wave is then sent as a radio wave of 315 MHz from the antenna 6. The transmitted radio wave is received by a receiver (not shown). Thus, the temperature of the object can be remotely grasped.

In this temperature monitoring apparatus, the GND wire 17D in the sensor cable 17A connected to the temperature sensor 17, which is externally provided separately from the casing 15, is used as a ground part for configuring a pseudo-equipotential surface, and the length of the GND wire 17D is brought to λ/4. By virtue of this construction, a pseudo-dipole antenna of two perfect balanced lines can be provided. Therefore, the radiation of radio waves can be improved. Further, since the temperature sensor 17 is provided separately and apart from the casing 15 and, in this state, is connected through a sensor cable 17A, unlike the integral structure in which the temperature sensor 17 is housed in the casing 15, there is no fear of the follow-up property of the sensor 17 with respect to a temperature change being deteriorated by heat drawing of the object to be monitored depending upon the heat capacity based on the material and shape of the casing 15.

Also in the fourth preferred embodiment, the length of the GND wire 17D is not limited to λ/4, and, for example, the use of two λ/4-long ground wires, i.e., a length of 2×λ/4, may be adopted.

Figure 9:
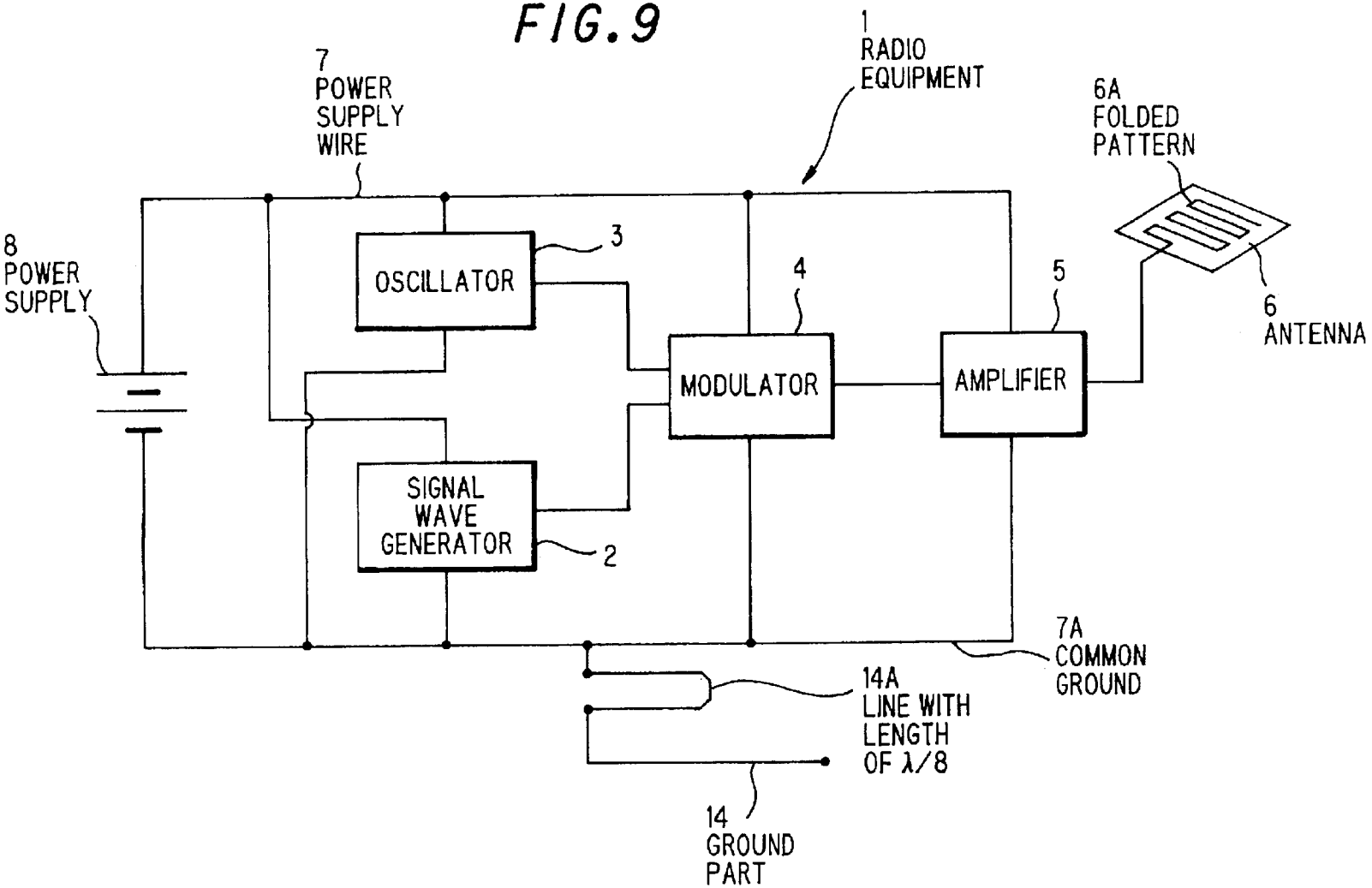
FIG. 9 is a schematic diagram showing the construction of radio equipment in a fifth preferred embodiment of the invention.

FIG. 9 is a schematic diagram showing radio equipment in a fifth preferred embodiment of the invention. In this radio equipment 1, a line 14A with a length of λ/8 is provided as a balanced matching part between a common ground 7A and a ground part 14. The other construction and function are the same as those explained above in connection with the second preferred embodiment (FIG. 4) of the invention, and, in FIGS. 4 and 9, like parts are identified with the same reference numerals for omitting the overlapped explanation of the like parts.

The power supply wire 7 and the common ground 7A provided in the radio equipment 1 sometimes cause an electric moment depending upon the scale and the resistance value of the battery 8 as the power supply. In some cases, the occurrence of the electric moment hinders the distribution of voltage in the antenna 6 or the ground part 14. This sometimes makes it impossible to provide the function of a λ/2-long antenna and results in remarkably deteriorated radiation of radio waves. The provision of the line 14A with a length of λ/8 can cope with the occurrence of the electric moment. That is, the provision of the line 14A can provide balanced matching and can ensure operation of the λ/2-long antenna as a whole. The λ/8-long line 14A may be formed of a copper foil pattern near the GND wire 7A, or alternatively may be formed by winding a conductor wire. In these cases, the same effect can be attained.

In the circuit construction of the above radio equipment, in order to stably radiate radio waves from the antenna 6, a given level of difference in impedance should be ensured between the antenna and the battery 8 as the power supply. According to studies conducted by the present inventor, in each of the above preferred embodiments, good transmission characteristics can be provided when the impedance of the antenna 6 is 50 Ω and the impedance of the battery 8 is 5 to 7 Ω. This demonstrates that the impedance of the power supply is preferably not less than 10% of the impedance of the antenna 6.

The construction of each of the above preferred embodiments uses an antenna as a substrate member having a folded pattern formed of a copper foil. Alternatively, the antenna may have a structure having a rod element made of a highly electrically conductive metal material or an antenna having an antenna pattern formed of a copper foil on a film base. The part provided as a ground may also have the same construction as the antenna or a construction which can form an electric field equivalent to that of the antenna and consequently can form an equipotential surface.

The invention has been explained by taking the construction of a transmitter as an example. The invention, however, can also be applied to a transmitter-receiver.

As described above, according to the radio equipment of the invention, a ground part electrically equivalent to an antenna is provided to form an equipotential surface. By virtue of this construction, radio waves can be stably radiated even under ungroundable conditions, and good characteristics can be provided even under low transmission output conditions.

The invention has been described in detail with particular reference to preferred embodiments, but it will be understood that variations and modifications can be effected within the scope of the invention as set forth in the appended claims.

What is claimed is:

1. Radio equipment comprising:

an antenna for radiating radio waves; and a ground part configured as an antenna armature so as to be equivalent to the antenna, wherein the antenna and the ground part compose a pseudo dipole antenna.

2. The radio equipment according to claim 1, wherein said antenna and said ground part each are formed of a conductor having at least one quarter of the wavelength of the radio wave.

3. The radio equipment according to claim 1, wherein said ground part is formed of a copper foil pattern provided on a circuit board.

4. Radio equipment comprising:

an antenna for radiating radio waves; and a ground part configured in the same form as the antenna, wherein the antenna and the ground part compose a pseudo dipole antenna.

5. The radio equipment according to claim 4, wherein said antenna and said ground part each are formed of a conductor having at least one quarter of the wavelength of the radio wave.

6. The radio equipment according to claim 4, wherein said ground part is formed of a copper foil pattern provided on a circuit board.

7. Radio equipment comprising:

an antenna for radiating radio waves;

a sensor for measuring a physical quantity and converting the physical quantity to an electric signal which is then output;

a transmission circuit for sending the electric signal as the radio wave;

a casing for housing therein the transmission circuit and the sensor; and a ground part configured as an antenna armature so as to be equivalent to the antenna, wherein the antenna and the ground part compose a pseudo dipole antenna.

8. The radio equipment according to claim 7, wherein said antenna and said ground part each are formed of a conductor having at least one quarter of the wavelength of the radio wave.

9. The radio equipment according to claim 7, wherein said ground part is formed of a copper foil pattern provided on a circuit board.

10. Radio equipment comprising:

an antenna for radiating radio waves;

a sensor for measuring a physical quantity and converting the physical quantity to an electric signal which is then output;

a transmission circuit for sending the electric signal as the radio wave;

a casing for housing therein the transmission circuit, said sensor being provided separately from and outside the casing, said sensor and said transmission circuit being connected to a common ground; and a ground part configured as an antenna armature so as to be equivalent to the antenna, wherein the antenna and the ground part compose a pseudo dipole antenna.

11. The radio equipment according to claim 10, wherein said antenna and said ground part each are formed of a conductor having at least one quarter of the wavelength of the radio wave.

12. The radio equipment according to claim 10, wherein said ground part is formed of a copper foil pattern provided on a circuit board.

13. Radio equipment comprising:

an antenna for radiating radio waves;

a ground part configured as an antenna armature so as to be equivalent to the antenna; and a balanced matching part provided between the transmission circuit and the ground part for electrically realizing matching therebetween.

14. The radio equipment according to claim 13, wherein said antenna and said ground part each are formed of a conductor having at least one quarter of the wavelength of the radio wave.

15. The radio equipment according to claim 13, wherein said ground part is formed of a copper foil pattern provided on a circuit board.

* * * * *